United States Patent [19]

Frank et al.

[11] 3,994,730

[45] Nov. 30, 1976

[54] PHOTOGRAPHIC COLOR DEVELOPER MIXTURE

[75] Inventors: Karl Frank, Leverkusen; Max Heilmann, Cologne, both of Germany

[73] Assignee: AGFA-Gevaert, A.G., Leverkusen, Germany

[22] Filed: Sept. 17, 1973

[21] Appl. No.: 397,789

[30] Foreign Application Priority Data

Sept. 22, 1972 Germany ..... 2246610

[52] U.S. Cl. ..... 96/66.4

[51] Int. Cl.[2] ..... G03C 5/30

[58] Field of Search ..... 96/66, 22

[56] References Cited

UNITED STATES PATENTS

| | | | |
|---|---|---|---|
| 3,201,246 | 8/1965 | Allen et al. | 96/66.4 |
| 3,647,449 | 3/1972 | Malloy | 96/66 R |
| 3,746,544 | 7/1973 | Heilmann | 96/66.3 |
| 3,794,591 | 9/1973 | Brown | 252/178 |

*Primary Examiner*—Mary F. Kelley

*Attorney, Agent, or Firm*—Connolly and Hutz

[57] ABSTRACT

An aqueous alkaline developer mixture for preparing color photographic images containing a color developer of the p-phenylenediamine series a hydroxylamine compound and a hydroxyalkylidenediphosphonic acid or a water soluble salt of the said acid and at least a compound of the aminopolyphosphonic acid or of the aminopolycarboxylic acid series with improved resistance to oxidation and resistance to the formation of chalk deposits and high stability in storage.

7 Claims, No Drawings

PHOTOGRAPHIC COLOR DEVELOPER MIXTURE

This invention relates to an aqueous alkaline developer mixture with improved resistance to oxidation and resistance to the formation of chalk deposits and high stability in storage even at elevated operating temperatures or prolonged storage times of several months which developer is used for the production of colored photographic images.

It is known that, apart from the developer substances required for developing exposed silver halide emulsion layers, other compounds may be added to photographic developers to improve other properties of the developer mixture, e.g. its resistance to oxidation or the resistance to precipitation of calcium compounds.

The last mentioned compounds are known as sequestering agents and serve mainly to prevent the formation of deposits when using hard water for preparing the developer mixture.

The sequestering agents used are mainly polyphosphates such as sodium hexametaphosphate or carboxylic acids which contain amino groups, e.g. ethylene diaminotetracetic acid. The efficiency of these compounds depends to a large extent on the composition of the developer. In black and white developers, for example, sequestering agents from both classes of substances mentioned above are useful but, in the case of color photographic developers, there are considerable difficulties. Sodium hexametaphosphate, for example, is not satisfactory for modern rapid development processes which are carried out at high temperatures and chalky deposits are formed within a fairly short time. The organophosphonic acids used commercially as sequestering agents such as phosphonosuccinic acid, phosphonobutanetricarboxylic acid or aminotrimethylenephosphonic acid have similar disadvantages in that they provide insufficient protection against the precipitation of calcium compounds in alkaline developer mixtures. Although ethylene diaminotetracetic acid is an excellent sequestering agent even for color photographic developers, its utility is limited by the fact that it considerably reduces the stability of color photographic developers, presumably due to the accelerated decomposition of the compounds such as hydroxylamine used to increase the stability to oxidation.

According to German Offenlegungsschrift No. 2,015,403, the decomposition of hydroxylamine in the presence of ethylene diaminotetracetic acid can be reduced by the addition of aromatic polyhydroxyl compounds.

One disadvantage of such a developer mixture, however, is that the aqueous solution becomes colored due to complex formation of the additives with traces of heavy metals so that there is a risk of discoloration of the photographic materials.

It is an object of this invention to provide a color photographic developer mixture which is resistant to atmospheric oxygen and to the formation of chalky deposits. It is a particular object of this invention to improve the stability of color photographic developers which contain hydroxylamine or its derivatives as antioxidizing agent. In addition, the developer mixture is also required to be suitable for modern rapid development processes.

It has now been found an aqueous alkaline developer mixture for the preparation of color photographic images which mixture contains a color developer of the p-phenylene diamine series, an antioxidizing agent of the hydroxylamine series and, in addition, hydroxyalkylidene diphosphonic acid or a water-soluble salt of the acid and at least one compound of the aminocarboxylic acid series or of the aminophosphonic acid series as sequestering agents which mixture have excellent properties as regards a. increased resistance of the color developer to oxidation, b. increased protection against the deposition of calcareous precipitates and c. increased stability of the hydroxylamine compound added, all these properties being maintained even if the developer mixture is stored for several weeks or if it is stored at a temperature of 50° C for several days.

The excellent effect of hydroxylalkylidene diphosphonic acid as protective agent against the decomposition of hydroxylamines in acid neutralisation baths has been described in German Offenlegungsschrift No. 2,127,942.

It has surprisingly been found that hydroxyalkylidene diphosphonic acids are highly compatible with the color developer compounds even in strongly alkaline color developer mixtures at pH values of 7 to 11, especially 8 to 11, and that they also reduce the decomposition of hydroxylamines within these ranges of pH.

In addition, hydroxyalkylidene diphosphonic acids are photographically inert at the concentrations and pH values used so that they have no harmful effect on the development process which produces the color.

When hydroxyalkylidene diphosphonic acids or their salts are used as the only sequestering agents as described in GErman Auslegeschrift No. 1,082,235, it is found that the sequestering action is insufficient if the color developer mitures have a high concentration of calcium ions. In conventional color developer mixtures, lime deposits are observed after a storage time of more than 3 days at 50° C.

This formation of deposits is particularly marked if the color developer mixtures have a higher than usual salt concentration, as, for example, when neutral salts such as sodium or potassium sulfate are added to the color developer mixture to reduce swelling of the photographic materials. In developer mixtures of this kind, cloudiness is observed after only a few minutes.

According to the invention, this problem can be solved if, in addition to a color developer of the p-phenylene diamine series and an antioxidizing agent of the hydroxylamine series, the color developer mixture contains a hydroxyalkylidene diphosphonic acid or a water-soluble salt of the acid and the compounds of the aminopolyphosphonic acid or of the aminocarboxylic acid series as sequestering agents.

The invention thus relates to an aqueous alkaline developer mixture for preparing color photographic images by using a color developer of the p-phenylenediamine series and a hydroxylamine compound, characterized by containing a hydroxyalkylidene diphosphonic acid or a water-soluble salt of the said acid and at least a compound of the aminopolyphosphonic acid or of the aminopolycarboxylic acid series.

The hydroxyalkylidene diphosphonic acid contained in the developer mixture according to the invention is preferably a compound of the following general formula

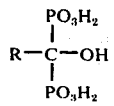

in which R represents a short alkyl group preferably containing from 1 – 5 carbon atoms, particularly methyl.

Suitable water-soluble salts of the hydroxyalkylidene diphosphonic acid are in particular the alkali metal salts, e.g. sodium or potassium salts, and ammonium salts, pyridinium salts, triethanolammonium salts and triethylammonium salts. The developer mixture according to the invention preferably contains 1-hydroxyethane-1,1-diphosphonic acid or water-soluble salts thereof.

Compounds of the aminopolyphosphonic acid or the aminopolycarboxylic acid series suitable for use as sequestering agents for the developer mixture according to the invention are, for example, ethylene diaminotetramethylentetraphosphonic acid, ethylene diaminotetracetic acid, diethylene triaminopentacetic acid, hydroxyethylethylene diaminotriacetic acid, isopropanoldiaminotetracetic acid, cyclohexanediaminotetracetic acid and aminomalonic acid.

Water-soluble salts of aminopolyphosphonic acids or of aminopolycarboxylic acids may, of course, also be used in the developer mixture according to the invention, e.g. sodium, potassium, ammonium, pyridinium, triethylammonium and triethanolammonium salts.

It has surprisingly been found that the combination of compounds of the aminopolyphosphonic acids or of the aminopolycarboxylic acid series with hydroxyalkylidene diphosphonic acid compounds in the color developer mixture according to the invention does not reduce the stability of the hydroxylamine which has been added and consequently increased protection against the precipitation of calcium compounds is ensured, even in color developer mixtures which have a high calcium content and/or an extremely high concentration of neutral salts.

Color developer mixtures according to the invention which have a high calcium content and/or a high salt content remain completely clear even when stored for a considerable length of time at elevated temperatures. This is particularly surprising in view of the fact that the organophosphonic acids mentioned above lose their activity after only a short time under the extreme conditions employed. The hydroxylalkylidene diphosphonic acid or its water-soluble salt added to the mixture does not lose its activity as protective substance for hydroxylamine compounds under the extreme conditions employed and therefore has an excellent stabilizing effect on the color developer mixtures according to the invention over prolonged periods of time extending to several weeks and/or at the elevated operating temperatures employed for modern rapid development processes.

The mechanism by which the hydroxyalkylidene acids or their water-soluble salts prevent the decomposition of hydroxylamine is not known. Possibly these compounds inhibit the action of heavy metal traces which accelerate the decomposition of hydroxylamine. As described in German Offenlegungsschrift No. 2,127,942, however, the addition of chelate-forming substances which are capable of binding traces of heavy metal by complex formation does not invariably prevent the decomposition of hydroxylamine. The combination of additives in the developer mixtures according to the invention is distinguished by unexpected advantages. On the one hand, the efficient sequestering agent of the aminopolycarboxylic acid series binds the calcium ions present in the developer solution while on the other hand the chelate forming substances of the aminopolycarboxylic acid series of which it was already known, as described above, that ethylene diaminotetracetic acid, in particular, accelerates the decomposition of hydroxylamine, do not impair the efficient stabilizing effect of hydroxyalkylidene diphosphonic acid on hydroxylamine.

Compounds of the aminopolycarboxylic acid series, as described, for example, in U.S. Pat. Nos. 2,875,049 and 3,462,269 and the ethylendiaminetetramethylenetetraphosphonic acid as described in French Pat. No. 1,319,265, do not accelerate the decomposition of hydroxylamine compounds and the stability of the hydroxylamine compound added to the developer mixture according to the invention is increased by the addition of these chelate forming substances together with the hydroxylalkylidene diphosphonic acid compound.

The hydroxyalkylidene diphosphonic acids form colorless complexes with the heavy metal traces present in tapwater and in the chemicals used and are therefore superior to the protective substances described in German Offenlegungsschrift No. 2,015,403.

The concentrations in which the hydroxyalkylidene diphosphonic acid or its water-soluble salts and the aminopolyphosphonic acid or the aminopolycarboxylic acid are added to the color developer mixture according to the invention may vary within wide limits. They depend on the nature of the developer, the degree of contamination of the developer solution with heavy metal salts or calcium salts, the quantity of hydroxylamine compound added and the effect desired. Concentrations of from 0.1 to 10 g of hydroxyalkylidene diphosphonic acid or its water-soluble salts per liter of developer mixture have generally been found to give optimum results. The concentrations of aminopolyphosphonic acids or aminopolycarboxylic acids in the solution is not critical but should be sufficient to bind all the calcium salts present by complex formation. An excess of aminopolyphosphonic acid or amino polycarboxylic acid does not alter the properties of the developer mixture achieved by the invention. Concentrations of from 0.5 to 25 g of aminopolyphosphonic acid or aminopolycarboxylic acid per liter of solution ready for use would generally appear to be sufficient. The color developers in the color developer mixtures according to the invention are in particular those of the p-phenylenediamine series which contain at least one primary amine group. The following are examples of suitable color developers: N,N-Diethyl-p-phenylenediamine, N-ethyl-N-β-hydroxyethyl-p-phenylenediamine, N-butyl-N-ω-sulfobutyl-p-phenylenediamine, N-ethyl-N-sulfamidoethyl-p-phenylenediamine, 4-amino-3-methyl-diethylaniline, 4-amino- 3-methyl-N-ethyl-N-β-methanesulfamidoethyl-aniline or N-ethyl-N-β-hydroxyethyl-3-methyl-4-aminoaniline. Other suitable color developers have been described in U.S. Pat. Nos. 653,284; 2,603,659 and 2,193,015.

The color developer mixtures according to the invention may contain hydroxylamine or hydroxylamine salts or derivatives as well as alkali metal sulfites and antioxidizing agent.

In addition, the color developer mixtures according to the invention may contain the usual additives, e.g. alkalis such as sodium or potassium carbonate, sodium boate, phosphates of sodium, ammonium or potassium, hydroxides of sodium or potassium, development accelerators or development retarders such as sodium or potassium bromide or potassium iodide, antifogging agents, stabilizers and neutral salts such as sodium sulfate.

Color developer mixtures used for modern rapid processes contain not only the usual additives but in addition neutral salts which prevent swelling of the gelatine, e.g. sulfates of potassium or sodium used in concentrations of 20 to 150 g, preferably 40 to 100 g.

The following examples serve to explain the invention.

The developer mixtures described below are prepared using tap water. Since the concentration of traces of heavy metal in tap water may fluctuate considerably, the quantity of water required for one example was put aside in a vessel and then used for preparing the developer mixtures described below. Whereas the developer mixtures of an Example described below are comparable to each other, developer mixtures of the different Examples are not necessarily comparable to each other since the concentration of heavy metal ions fluctuate as well in tap water as in the additives used for the preparation of the different developer mixtures.

EXAMPLE 1

A developer mixture of the following basic composition:

| | |
|---|---|
| Potassium carbonate | 100 g |
| Sodium sulfite | 4 g |
| Hydroxylamine sulfate | 4 g |
| Potassium bromide | 1 g |
| N-butyl-N- β -sulfobutyl-p-phenylenediamine | 6 g |
| Water up to | 1 l |

was prepared using tap water to which the following substances had previously been added as sequestering agents:

Developer 1

5 ml of a 60 % aqueous solution of 1-hydroxyethane diphosphonic acid

Developer 2

4 g of the tetrasodium salt of ethylenediaminotetracetic acid

Developer 3

4 g of diethylene triaminopentacetic acid

Developer 4

4 g of hydroxyethyl ethylene diaminotriacetic acid

Developer 5

4 g of the tetrasodium salt of ethylenediaminotetracetic acid and 5 ml of a 60 % aqueous solution of 1-hydroxyethane diphosphonic acid

Developer 6

4 g of diethylenetriaminopentacetic acid and 5 ml of a 60 % aqueous solution of 1-hydroxyethane diphosphonic acid

Developer 7

4 g of hydroxyethyl ethylenediaminotriacetic acid and 5 ml of a 60 % aqueous solution of 1-hydroxyethane diphosphonic acid

Developer 8: without the addition of sequestering agent

Developer 8 used for comparison becomes cloudy within a few minutes due to the formation of calcareous deposit while developer solutions 1 – 7 are still clear.

Developer solutions 1 – 8 are stored at 50° C for 3 days with the exclusion of air and the hydroxylamine content still present is then determined at the end of this time.

The analytical results and the assessment of the presence (+) or absence (−) of cloudiness due to the formation of lime deposits after storage of the developer mixtures are summarized in Table 1 below.

Table 1

| Developer mixture | | 1 | 2 | 3 | 4 | 5 | 6 | 7 | 8 |
|---|---|---|---|---|---|---|---|---|---|
| hydroxylamine (g) | fresh | 4.0 | 4.0 | 4.0 | 4.0 | 4.0 | 4.0 | 4.0 | 4.0 |
| | after 3 days | 3.38 | 0.10 | 3.47 | 2.20 | 3.08 | 3.7 | 3.4 | 2.62 |
| Deposition of lime | fresh | — | — | — | — | — | — | — | + |
| | after 4 days | — | — | + | — | — | — | — | — |

The Table shows that developer mixtures 5 to 7 according to the invention are distinctly superior to the developer mixtures 1 to 4 and 8 which were prepared for comparison purposes. They are distinguished both by their excellent resistance to the precipitation of calcium compounds and by the excellent stability of the hydroxylamine. In addition, the stability of hydroxylamine could be considerably improved in the developer mixtures 3 and 4 used for comparison by the addition of 1-hydroxy-ethane diphosphonic acid, as the developer mixtures 6 and 7 according to the invention clearly demonstrate.

The color developer mixtures according to the invention can be used for considerable periods at elevated temperatures in a development apparatus and color wedges obtained by development have the same gradation as color wedges obtained with a fresh developer used at room temperature.

EXAMPLE 2

A developer mixture of the following basic composition:

| | |
|---|---|
| Hydroxylamine sulfate | 1.5 g |
| N-ethyl-N-β-hydroxyethyl-3-methyl-4-aminoaniline | 5 g |
| Sodium carbonate | 25 g |

-continued

| | | |
|---|---|---|
| Potassium sulfate | 100 | g |
| Potassium bromide | 1.5 | g |
| Sodium sulfite | 4 | g |
| Water up to | 1 | l |

was prepared using tap water to which the following substances had previously been added as sequestering agents:

Developer 9

2 g of the disodium salt of hydroxyethane diphosphonic acid

Developer 10

2 g of the disodium salt of hydroxyethane diphosphonic acid and 1.5 g of ethylene diaminotetracetic acid.

A fine, bulky precipitate of calcium compounds could be observed within a few minutes after the preparation of developer solution 9 while developer 10 according to the invention remained completely clear and could be used for development for a considerable time and at elevated temperatures.

EXAMPLE 3

A developer mixture of the following basic composition:

| | | |
|---|---|---|
| Hydroxylamine sulfate | 1.2 | g |
| N,N-diethyl-p-phenylene diaminosulfate | 2.75 | g |
| Potassium carbonate | 70 | g |
| Potassium bromide | 2 | g |
| Sodium sulfite | 2 | g |
| Water up to | 1 | l |

was prepared using tap water to which the following substances had previously been added as sequestering agents:

Developer 12

2 g of ethylene diaminotetracetic acid

Developer 13

2 g of diethylenetriaminopentacetic acid

Developer 14

2 g of ethylene diaminotetracetic acid and 2 g of the disodium salt of 1-hydroxyethanediphosphonic acid.

The developer solutions were kept in open vessels at room temperature and the residual hydroxylamine content (a) and N,N-diethyl-p-phenylenediaminosulfate content (b) were determined after 4 weeks' storage. The results of analysis are summarized in Table 2.

Table 2

| Developer mixtures | 12 | 13 | 14 |
|---|---|---|---|
| Content (a) [g/l] | 0 | 0.13 | 0.5 |
| Content (b) [g/l] | 1.9 | 2.16 | 2.75 |

After 4 weeks' storage, color developer mixture 14 according to the invention was found to be photographically distinctly superior to developer mixtures 12 and 13 used for comparison since the additives in developer solution 14 according to the invention increase the stability of the hydroxylamine added.

EXAMPLE 4

A developer mixture according to Example 3 was prepared by using tap water to which the following substances had been added as sequestering agents:

Developer 14

2 g of ethylene diaminotetracetic acid and 2 g of the disodium salt of 1-hydroxyethanediphosphonic acid Developer 15

2 g of ethylenediaminotetramethylenetetraphosphonic acid

Developer 16

2 g of ethylene diaminotetracetic acid and 2 g of ethylenediaminotetramethylenetetraphosphonic acid Developer 17

2 g of ethylenediaminotetramethylenetetraphosphonic acid and 2 g of the disodium salt of 1-hydroxyethanediphosphonic acid.

The developer solutions were kept in open vessels at room temperature and the residual hydroxylamine content (a) and N,N-diethyl-p-phenylenediaminesulfate content (b) were determined after 4 weeks' storage. The results of analysis are summarized in Table 3

Table 3

| Developer mixtures | 14 | 15 | 16 | 17 |
|---|---|---|---|---|
| Content (a) [g/l] | 0,45 | 0,52 | 0,42 | 0,606 |
| Content (b) [g/l] | 2,6 | 2,70 | 2,64 | 2,70 |

After 4 weeks' storage color developer mixture 17 according to the invention was found to photographically even more superior than the color developer mixture 14 according to the invention and than the color developer mixtures 15 and 16 used for comparison since the additives in developer solution 17 according to the invention highly increases the stability of the hydroxylamine added.

We claim:

1. An aqueous alkaline color developer composition with a p-phenylenediamine color developer, a hydroxylamine compound and a hydroxyalkylidene diphosphonic acid or a water soluble salt thereof of the formula

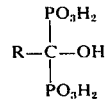

wherein R represents an alkyl group of from 1 to 5 carbon atoms, wherein the improvement comprises the composition contains a sequestering agent selected of the group consisting of ethylenediaminetetramethylenetetraphosphonic acid and an aminopolycarboxylic acid compound.

2. A composition of claim 1 wherein the water soluble salt is an alkali metal, ammonium, pyridinium, triethanolammonium or triethylammonium salt.

3. A composition of claim 1, wherein R represents methyl.

4. A composition of claim 1, wherein the sequestering agent used is ethylenediaminotetracetic acid, diethylenetriaminopentacetic acid, hydroxyethylethylenediaminotriacetic acid, isopropanoldiaminotetracetic acid, cyclohexanediaminotetracetic acid, aminomalonic acid or the water soluble salts thereof.

5. A composition of claim 1 containing 1-hydroxyethane-1, 1-diphosphonic acid and wherein the sequestering agent is an agent selected from the group consisting of ethylenediaminotetracetic acid, diethylenetriaminopentacetic acid, hydroxyethylethylenediaminotriacetic acid, isopropanoldiaminotetracetic acid, cyclohexanediaminotetracetic acid, aminomalonic acid or the water soluble salts thereof.

6. The combination of claim 1 wherein the aminopolycarboxylic acid compound is an aminopolyacetic acid compound.

7. An aqueous alkaline color developer composition comprising a p-phenylene diamine color developer, a hydroxyl amine compound, a hydroxyalkylidene diphosphonic acid of the formula:

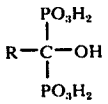

wherein R represents an alkyl group of from 1 to 5 carbon atoms, and an amino-polycarboxylic acid sequestering agent being 1,3-diamino-2-propanol tetraacetic acid.

* * * * *

UNITED STATES PATENT AND TRADEMARK OFFICE

CERTIFICATE OF CORRECTION

PATENT NO. : 3,994,730
DATED : NOVEMBER 30, 1976
INVENTOR(S) : KARL FRANK ET AL

It is certified that error appears in the above-identified patent and that said Letters Patent are hereby corrected as shown below:

Column 2, line 35, cancel "GErman" and replace with -- German--

Column 2, line 37, "mitures" should read -- mixtures -- .

Column 5, line 6, "boate" should read -- borate -- .

Table 1, last line should read as follows:

-- lime 4 days + - - - - - - + -- .

Signed and Sealed this

Nineteenth Day of April 1977

[SEAL]

*Attest:*

RUTH C. MASON
*Attesting Officer*

C. MARSHALL DANN
*Commissioner of Patents and Trademarks*